US008848925B2

(12) United States Patent
Tammi

(10) Patent No.: US 8,848,925 B2
(45) Date of Patent: Sep. 30, 2014

(54) METHOD, APPARATUS AND COMPUTER PROGRAM PRODUCT FOR AUDIO CODING

(75) Inventor: Mikko Tammi, Tampere (FI)

(73) Assignee: Nokia Corporation, Espoo (FI)

( * ) Notice: Subject to any disclaimer, the term of this patent is extended or adjusted under 35 U.S.C. 154(b) by 290 days.

(21) Appl. No.: 13/395,290

(22) PCT Filed: Sep. 11, 2009

(86) PCT No.: PCT/FI2009/050734

§ 371 (c)(1),
(2), (4) Date: May 22, 2012

(87) PCT Pub. No.: WO2011/029984

PCT Pub. Date: Mar. 17, 2011

(65) Prior Publication Data

US 2012/0232912 A1 Sep. 13, 2012

(51) Int. Cl.

| | |
|---|---|
| ***H04R 5/00*** | (2006.01) |
| ***G10L 19/00*** | (2013.01) |
| ***G10L 19/008*** | (2013.01) |
| ***G10L 19/022*** | (2013.01) |
| *G10L 19/16* | (2013.01) |
| *G10L 19/02* | (2013.01) |

(52) U.S. Cl.

CPC ..... *G10L 19/022* (2013.01); *G10L 19/167* (2013.01); *G10L 19/008* (2013.01); *G10L 19/0204* (2013.01)

USPC ..... 381/17; 704/500

(58) Field of Classification Search

CPC ... G10L 19/008; G10L 19/20; G10L 19/0017; G10L 19/0204; G10L 19/025; H04S 2420/03; H04S 2400/11; H04S 1/005; H04S 5/00; H04S 2420/01

USPC ..... 704/500–504; 381/17–23

See application file for complete search history.

(56) References Cited

U.S. PATENT DOCUMENTS

| | | | | |
|---|---|---|---|---|
| 8,194,884 | B1 * | 6/2012 | Johnston | 381/97 |
| 2003/0026441 | A1 * | 2/2003 | Faller | 381/98 |

(Continued)

FOREIGN PATENT DOCUMENTS

| | | | |
|---|---|---|---|
| EP | 1 912 206 | A1 | 4/2008 |
| WO | WO 2007/109338 | A1 | 9/2007 |

OTHER PUBLICATIONS

Faller, "Parametric Multichannel Audio Coding: Synthesis of Coherence Cues", IEEE Transactions on Speech and Audio Processing, vol. 14, No. 1, Jan. 2006.*

(Continued)

*Primary Examiner* — Samuel G Neway
(74) *Attorney, Agent, or Firm* — Harrington & Smith

(57) ABSTRACT

The invention relates to a method and an apparatus in which samples of at least a part of an audio signal of a first channel and a part of an audio signal of a second channel are used to estimate a time delay between said part of the audio signal of said first channel and said part of the audio signal of said second channel. The method includes windowing the samples; performing a time-to-frequency domain transform; and determining an inter-channel time delay between said part of the audio signal of the first channel and said part of the audio signal of said second channel on the basis of the frequency domain representations. There is also disclosed a method and an apparatus for decoding the encoded samples.

19 Claims, 5 Drawing Sheets

(56) References Cited

U.S. PATENT DOCUMENTS

| | | | | |
|---|---|---|---|---|
| 2006/0190247 | A1* | 8/2006 | Lindblom | 704/230 |
| 2006/0233379 | A1* | 10/2006 | Villemoes et al. | 381/23 |
| 2007/0036360 | A1* | 2/2007 | Breebaart | 381/23 |
| 2007/0127729 | A1* | 6/2007 | Breebaart et al. | 381/18 |
| 2008/0215317 | A1 | 9/2008 | Fejzo | |
| 2008/0310646 | A1* | 12/2008 | Amada | 381/73.1 |
| 2009/0150161 | A1* | 6/2009 | Faller | 704/500 |
| 2009/0222272 | A1 | 9/2009 | Seefeldt et al. | |
| 2010/0054482 | A1* | 3/2010 | Johnston | 381/17 |

OTHER PUBLICATIONS

Breebaart et al., "Parametric Coding of Stereo Audio", EURASIP Journal on Applied Signal Processing, 2005.*

Jan, E-E., et al., "Sound Source Localization in Reverberant Environments Using an Outlier Elimination Algorithm" , Oct. 3, 1996, IEEE, 4 pgs.

Roy, O, et al., "Distributed Spatial Audio Coding in Wireless Hearing Aids", © 2007 IEEE, 4 pgs.

Chen, J-T., et al., "Car Speech Enhancement Using a Microphone Array", © 2005 Springer Science + Business Media, Inc.., 13 pgs.

* cited by examiner

METHOD, APPARATUS AND COMPUTER PROGRAM PRODUCT FOR AUDIO CODING

TECHNICAL FIELD

The present invention relates to a method, an apparatus and a computer program product for coding audio signals.

BACKGROUND INFORMATION

Spatial audio processing is the effect of an audio signal originating from an audio source arriving at the left and right ears of a listener via different propagation paths. As a consequence of this effect the signal at the left ear will typically have a different arrival time and signal level from those of the corresponding signal arriving at the right ear. The differences between the arrival times and signal levels are functions of the differences in the paths by which the audio signal travelled in order to reach the left and right ears respectively. The listener's brain then interprets these differences to give the perception that the received audio signal is being generated by an audio source located at a particular distance and direction relative to the listener. An auditory scene therefore may be viewed as the net effect of simultaneously hearing audio signals generated by one or more audio sources located at various positions relative to the listener.

The mere fact that the human brain can process a binaural input signal in order to ascertain the position and direction of a sound source can be used to encode and synthesise auditory scenes. A typical method of spatial auditory coding may thus attempt to model the salient features of an audio scene, by purposefully modifying audio signals from one or more different sources (channels). This may be for headphone use defined as left and right audio signals. These left and right audio signals may be collectively known as binaural signals. The resultant binaural signals may then be generated such that they give the perception of varying audio sources located at different positions relative to the listener. A binaural signal typically exhibits two properties not necessarily present in a conventional stereo signal. Firstly, a binaural signal has incorporated the time difference between left and right and, secondly, the binaural signal models the so called "head shadow effect", which results in a reduction of volume for certain frequency bands.

Recently, spatial audio techniques have been used in connection with multichannel audio reproduction. The objective of multichannel audio reproduction is to provide for efficient coding of multi channel audio signals comprising a plurality of separate audio channels and/or sound sources. Recent approaches to the coding of multichannel audio signals have centred on the methods of parametric stereo (PS), such as Binaural Cue Coding (BCC). BCC typically encodes the multi-channel audio signal by down mixing the input audio signals into either a single ("sum") channel or a reduced number of channels conveying the "sum" signal. The "sum" signal may be also referred to as a downmix signal. In parallel, the most salient inter channel cues, otherwise known as spatial cues, describing the multi-channel sound image or audio scene are extracted from the input channels and encoded as side information. Both the sum signal and side information from the encoded parameter set which can then either be transmitted as part of a communication chain or stored in a store and forward type device. Many implementations of the BCC technique employ a low bit rate audio coding scheme to further encode the sum signal. Subsequently, the BCC decoder generates a multi-channel output signal from the transmitted or stored sum signal and spatial cue information. Typically "sum" signals (i.e. downmix signals) employed in spatial audio coding systems are additionally encoded using low bit rate perceptual audio coding techniques, such as Advanced Audio Coding (AAC) or ITU-T Recommendation G.718 to further reduce the required bit rate.

In stereo coding of audio signals two audio channels are encoded. In many cases the audio channels may have rather similar content at least part of a time. Therefore, compression of the audio signals can be performed efficiently by coding the channels together. This results in overall bit rate which can be lower than the bit rate required for coding channels independently.

A commonly used low bit rate stereo coding method is known as the parametric stereo coding. In parametric stereo coding a stereo signal is encoded using a mono coder and parametric representation of the stereo signal. The parametric stereo encoder computes a mono signal as a linear combination of the input signals. The mono signal may be encoded using conventional mono audio encoder. In addition to creating and coding the mono signal, the encoder extracts parametric representation of the stereo signal. Parameters may include information on level differences, phase (or time) differences and coherence between input channels. In the decoder side this parametric information is utilized to recreate stereo signal from the decoded mono signal. Parametric stereo is an improved version of the intensity stereo coding, in which only the level differences between channels are extracted.

Another common stereo coding method, especially for higher bit rates, is known as mid-side stereo, which can be abbreviated as M/S stereo. Mid-side stereo coding transforms the left and right channels into a mid channel and a side channel. The mid channel is the sum of the left and right channels, whereas the side channel is the difference of the left and right channels. These two channels are encoded independently. With accurate enough quantization mid-side stereo retains the original audio image relatively well without introducing severe artifacts. On the other hand, for good quality reproduced audio the required bit rate remains at quite a high level.

In many cases stereo signals are generated artificially by panning different sound sources to two channels. In these cases there typically are not time delays between channels, and the signals can be efficiently encoded using for example parametric or mid-side coding.

A special case of a stereo signal is a binaural signal. A binaural audio signal may be recorded for example by using microphones mounted in an artificial head or with a real user wearing a head set with microphones in the close proximity of his/her ears, or by using other real recording arrangement with two microphones close to each other. These kind of signals can also be artificially generated. For example, binaural signals can be generated by applying suitable head related transfer functions (HRTF) or corresponding head related impulse responses (HRIR) to a source signal. All these discussed signals have one special feature not typically present in generic two-channel audio: both channels contain in principle the same source signals with a different time delay and frequency dependent amplification. Time delay is dependent on the direction of arrival of the sound. In the following, all these kinds of signals are referred as binaural audio.

One problem is how to reduce the number of bits needed to encode good quality binaural audio. Mid-side stereo coding and parametric stereo coding techniques do not perform well, as they may not take into consideration time delays between channels. In case of parametric stereo, the time delay information may be totally lost. Mid-side stereo, on the other hand, may require high bit rate for binaural signals for good quality. For maximum compression with good quality, binaural audio specific coding method should be used.

It is feasible to think that two binaural channels can be efficiently joined into one channel, such as in parametric stereo coding, if the signals can first be time aligned, i.e. the time delays between channels are removed. Similarly, the time differences can be restored in the decoder. Alternatively, the time aligned signals can be used for improving the efficiency of mid-side stereo coding.

One difficulty in time alignment lies in the fact that the time differences between channels of an input signal may be different for different time and frequency locations. In addition, there may be several source signals occupying the same time-frequency location. Further, the time alignment has to be performed carefully because if time shifts are not performed cautiously, perceptual problems may arise.

SUMMARY OF SOME EXAMPLES OF THE INVENTION

In an example embodiment of the present invention a low complexity frequency domain implementation is introduced for binaural coding. The embodiment comprises dividing the audio spectrum of the audio channels into two or more subbands and selecting the delays for the subbands in each channel. The operations to determine the delays are mainly performed in frequency domain.

The audio signals of the input channels are digitized to form samples of the audio signals. The samples may be arranged into input frames, for example, in such a way that one input frame may contain samples representing 10 ms or 20 ms long period of the audio signal. Input frames may further be organized are divided into analysis frames which may or may not be overlapping. The analysis frames are windowed with windows, for example with sinusoidal windows, padded with certain values at one or both ends, and transformed into frequency domain using a time-to-frequency domain transform. An example of such transform is the Discrete Fourier Transform (DFT). The values added at the end(s) of overlapping windows enable delay modification without practically any perceptual artifacts. Each channel may be divided into subbands, and for every channel the delay differences between channels are analysed using a frequency domain method. The subband of one channel is shifted to obtain the best match with the corresponding subband of the other channel. The operations can be repeated for every subband. Both parametric stereo or mid-side stereo type implementation can be used for encoding the aligned signals.

On the decoder side, the original delays are restored to the signals. An efficient decorrelation can be performed to improve the spatial image of synthesized signals.

According to a first aspect of the present invention there is provided a method comprising using samples of at least a part of an audio signal of a first channel and a part of an audio signal of a second channel to estimate a time delay between said part of the audio signal of said first channel and said part of the audio signal of said second channel;

characterized in that the method comprises windowing the samples of said first channel and said second channel by a window function to form an analysis frame of said first channel and an analysis frame of said second channel;

performing a time-to-frequency domain transform on the analysis frames to form a frequency domain representation of said part of the audio signal of said first channel and said part of the audio signal of said second channel; and determining an inter-channel time delay between said part of the audio signal of the first channel and said part of the audio signal of said second channel on the basis of the frequency domain representations.

According to a second aspect of the present invention there is provided method comprising receiving an encoded audio signal of a first channel and an encoded audio signal of a second channel;

characterized in that the method comprises receiving an indication of an inter-channel time delay between said encoded audio signal of the first channel and said encoded audio signal of the second channel;

decoding said encoded audio signal of the first channel and said encoded audio signal of the second channel to form decoded samples of the audio signal of the first channel and the audio signal of the second channel;

performing a time-to-frequency domain transform on the windowed samples to form a frequency domain representation of said audio signal of said first channel and said audio signal of said second channel;

shifting the frequency domain representation of one of said audio signal of said first channel and said audio signal of said second channel on the basis of said indication;

performing a frequency-to-time domain transform on the frequency domain representation of said audio signal of said first channel and said audio signal of said second channel to form decoded samples of the audio signal of the first channel and of the audio signal of the second channel; and windowing said decoded samples of said first channel and said second channel by a window function to form a synthesized audio signal of the first channel and a synthesized audio signal of the second channel.

According to a third aspect of the present invention there is provided an apparatus comprising means for using samples of at least a part of an audio signal of a first channel and a part of an audio signal of a second channel to estimate a time delay between said part of the audio signal of said first channel and said part of the audio signal of said second channel;

characterized in that the apparatus comprises means for windowing the samples of said first channel and said second channel by a window function to form an analysis frame of said first channel and an analysis frame of said second channel;

means for performing a time-to-frequency domain transform on the analysis frames to form a frequency domain representation of said part of the audio signal of said first channel and said part of the audio signal of said second channel; and means for determining an inter-channel time delay between said part of the audio signal of the first channel and said part of the audio signal of said second channel on the basis of the frequency domain representations.

According to a fourth aspect of the present invention there is provided an apparatus comprising means for receiving an encoded audio signal of a first channel and an encoded audio signal of a second channel;

characterized in that the apparatus comprises means for receiving an indication of an inter-channel time delay between said encoded audio signal of the first channel and said encoded audio signal of the second channel;

means for decoding said encoded audio signal of the first channel and said encoded audio signal of the second channel to form decoded samples of the audio signal of the first channel and the audio signal of the second channel;

means for performing a time-to-frequency domain transform on the windowed samples to form a frequency domain representation of said audio signal of said first channel and said audio signal of said second channel;

means for shifting the frequency domain representation of one of said audio signal of said first channel and said audio signal of said second channel on the basis of said indication;

means for performing a frequency-to-time domain transform on the frequency domain representation of said audio signal of said first channel and said audio signal of said second channel to form decoded samples of the audio signal of the first channel and of the audio signal of the second channel; and means for windowing said decoded samples of said first channel and said second channel by a window function to form a synthesized audio signal of the first channel and a synthesized audio signal of the second channel.

According to a fifth aspect of the present invention there is provided an apparatus comprising means for receiving an encoded audio signal of a first channel and an encoded audio signal of a second channel;

characterized in that the apparatus comprises means for receiving an indication of an inter-channel time delay between said encoded audio signal of the first channel and said encoded audio signal of the second channel;

means for decoding said encoded audio signal of the first channel and said encoded audio signal of the second channel to form decoded samples of the audio signal of the first channel and the audio signal of the second channel;

means for performing a time-to-frequency domain transform on the windowed samples to form a frequency domain representation of said audio signal of said first channel and said audio signal of said second channel;

means for shifting the frequency domain representation of one of said audio signal of said first channel and said audio signal of said second channel on the basis of said indication;

means for performing a frequency-to-time domain transform on the frequency domain representation of said audio signal of said first channel and said audio signal of said second channel to form decoded samples of the audio signal of the first channel and of the audio signal of the second channel; and means for windowing said decoded samples of said first channel and said second channel by a window function to form a synthesized audio signal of the first channel and a synthesized audio signal of the second channel.

According to a fifth aspect of the present invention there is provided a computer program product comprising a computer program code configured to, with at least one processor, cause an apparatus to:

use samples of at least a part of an audio signal of a first channel and a part of an audio signal of a second channel to estimate a time delay between said part of the audio signal of said first channel and said part of the audio signal of said second channel;

characterized in that the computer program product comprises a computer program code configured to, with at least one processor, cause the apparatus to window the samples of said first channel and said second channel by a window function to form an analysis frame of said first channel and an analysis frame of said second channel;

perform a time-to-frequency domain transform on the analysis frames to form a frequency domain representation of said part of the audio signal of said first channel and said part of the audio signal of said second channel; and determine an inter-channel time delay between said part of the audio signal of the first channel and said part of the audio signal of said second channel on the basis of the frequency domain representations.

According to a fifth aspect of the present invention there is provided a computer program product comprising a computer program code configured to, with at least one processor, cause an apparatus to:

receive an encoded audio signal of a first channel and an encoded audio signal of a second channel;

characterized in that the computer program product comprises a computer program code configured to, with at least one processor, cause the apparatus to receive an indication of an inter-channel time delay between said encoded audio signal of the first channel and said encoded audio signal of the second channel;

decode said encoded audio signal of the first channel and said encoded audio signal of the second channel to form decoded samples of the audio signal of the first channel and the audio signal of the second channel;

perform a time-to-frequency domain transform on the windowed samples to form a frequency domain representation of said audio signal of said first channel and said audio signal of said second channel;

shift the frequency domain representation of one of said audio signal of said first channel and said audio signal of said second channel on the basis of said indication;

perform a frequency-to-time domain transform on the frequency domain representation of said audio signal of said first channel and said audio signal of said second channel to form decoded samples of the audio signal of the first channel and of the audio signal of the second channel; and window said decoded samples of said first channel and said second channel by a window function to form a synthesized audio signal of the first channel and a synthesized audio signal of the second channel.

The methods according to some example embodiments of the present invention can be used both with mono and stereo core coding. Examples of both of these cases are presented in FIGS. 1*a* and 1*b*. In the case of stereo core codec, the binaural encoder only compensates for the delay differences between channels. The actual stereo codec can be in principle any kind of stereo codec such as an intensity stereo, parametric stereo or mid-side stereo codec. When mono core codec is used, binaural codec generates a mono downmix signal and encodes also level differences between the channels. In this case the binaural codec can be considered as a binaural parametric stereo codec.

The present invention may provide an improved and/or more accurate spatial audio image due to improved preservation of time difference between the channels, which is useful e.g. for binaural signals. Furthermore, to present invention may reduce computational load in binaural/multi-channel audio encoding.

DESCRIPTION OF THE DRAWINGS

In the following the invention will be explained in more detail with reference to the appended drawings, in which.

DETAILED DESCRIPTION OF THE INVENTION

Figure 2:
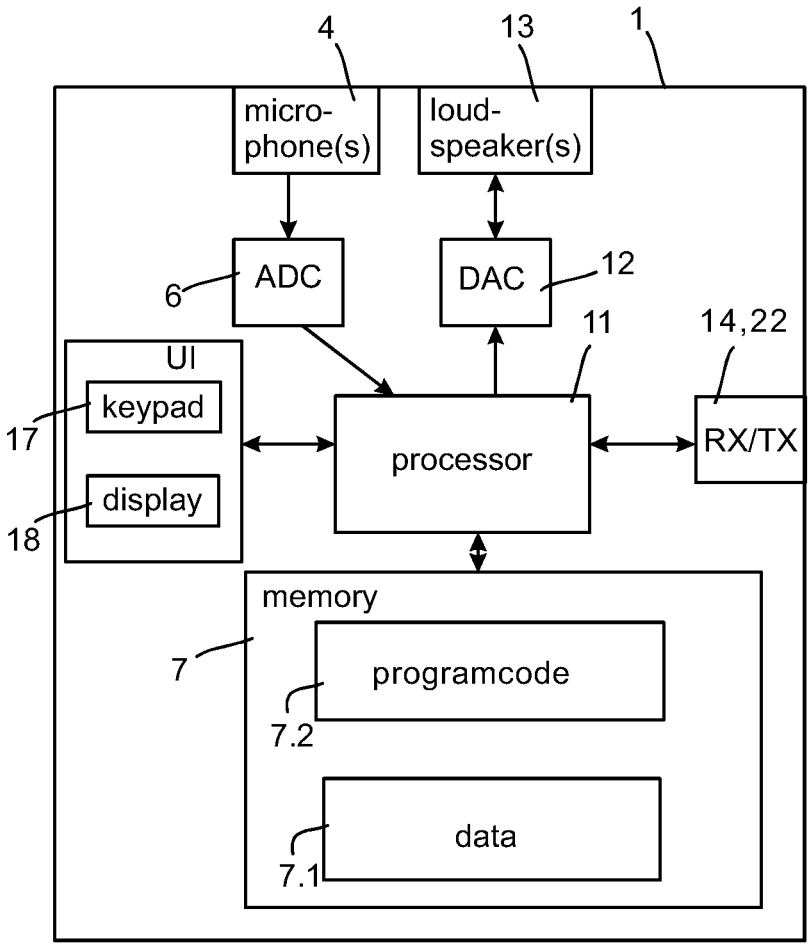
FIG. 2 depicts an example embodiment of the device in which the invention can be applied.

In the following an example embodiment of the apparatuses for encoding and decoding audio signals by utilising the present invention will be described. FIG. 2 shows a schematic block diagram of a circuitry of an exemplary apparatus or electronic device 1, which may incorporate a codec according to an embodiment of the invention. The electronic device may for example be a mobile terminal, user equipment of a wireless communication system, any other communication device, as well as a personal computer, a music player, an audio recording device, etc.

The electronic device 1 can comprise one or more microphones 4*a*, 4*b*, which are linked via an analogue-to-digital converter 6 to a processor 11. The processor 11 is further linked via a digital-to-analogue converter 12 to loudspeakers 13. The processor 11 is further linked to a transceiver (TX/RX) 14, to a user interface (UI) and to a memory 7.

The processor 11 may be configured to execute various program codes 7.2. The implemented program codes may comprise encoding code routines. The implemented program codes 15 may further comprise an audio decoding code routines. The implemented program codes 7.2 may be stored for example in the memory 7 for retrieval by the processor 11 whenever needed. The memory 7 may further provide a section 7.1 for storing data, for example data that has been encoded in accordance with the invention.

The encoding and decoding code may be implemented in hardware or firmware in embodiments of the invention.

The user interface may enable a user to input commands to the electronic device 1, for example via a keypad 17, and/or to obtain information from the electronic device 1, for example via a display 18. The transceiver 14 enables a communication with other electronic devices, for example via a wireless communication network. The transceiver 14 may in some embodiments of the invention be configured to communicate to other electronic devices by a wired connection.

It is to be understood again that the structure of the electronic device could be supplemented and varied in many ways. As an example, there may be additional functional elements in addition to those shown in FIG. 2 or some of the elements illustrated in FIG. 2 may be omitted. As another example, the electronic device may comprise one or more processors and/or one or more memory units, although depicted as a single processor 11 and a single memory unit 7 in FIG. 2.

A user of the electronic device may use the microphone 4 for inputting audio that is to be transmitted to some other electronic device or that is to be stored in the data section 7.1 of the memory 7. A corresponding application has been activated to this end by the user via the user interface 15. This application, which may be run by the processor 11, causes the processor 11 to execute the encoding code stored in the memory 7.

The analogue-to-digital converter 6 may convert the input analogue audio signal into a digital audio signal and provide the digital audio signal to the processor 11. The processor 11 may then process the digital audio signal in the same way as described with reference to the description hereafter.

Alternatively, instead of employing the microphone 4 for inputting the audio signal, a digital audio input signal may be pre-stored in the data section 7.1 of the memory 7 and read from the memory for provision to the processor 11.

The resulting bit stream may be provided to the transceiver 14 for transmission to another electronic device. Alternatively, the encoded data could be stored in the data section 7.1 of the memory 7, for instance for a later transmission or for subsequent distribution to another device by some other means, or for a later presentation or further processing by the same electronic device 1.

The electronic device may also receive a bit stream with correspondingly encoded data from another electronic device via the transceiver 14. In this case, the processor 11 may execute the decoding program code stored in the memory. Alternatively, the electronic device may receive the encoded data by some other means, for example as a data file stored in a memory.

Figure 3:
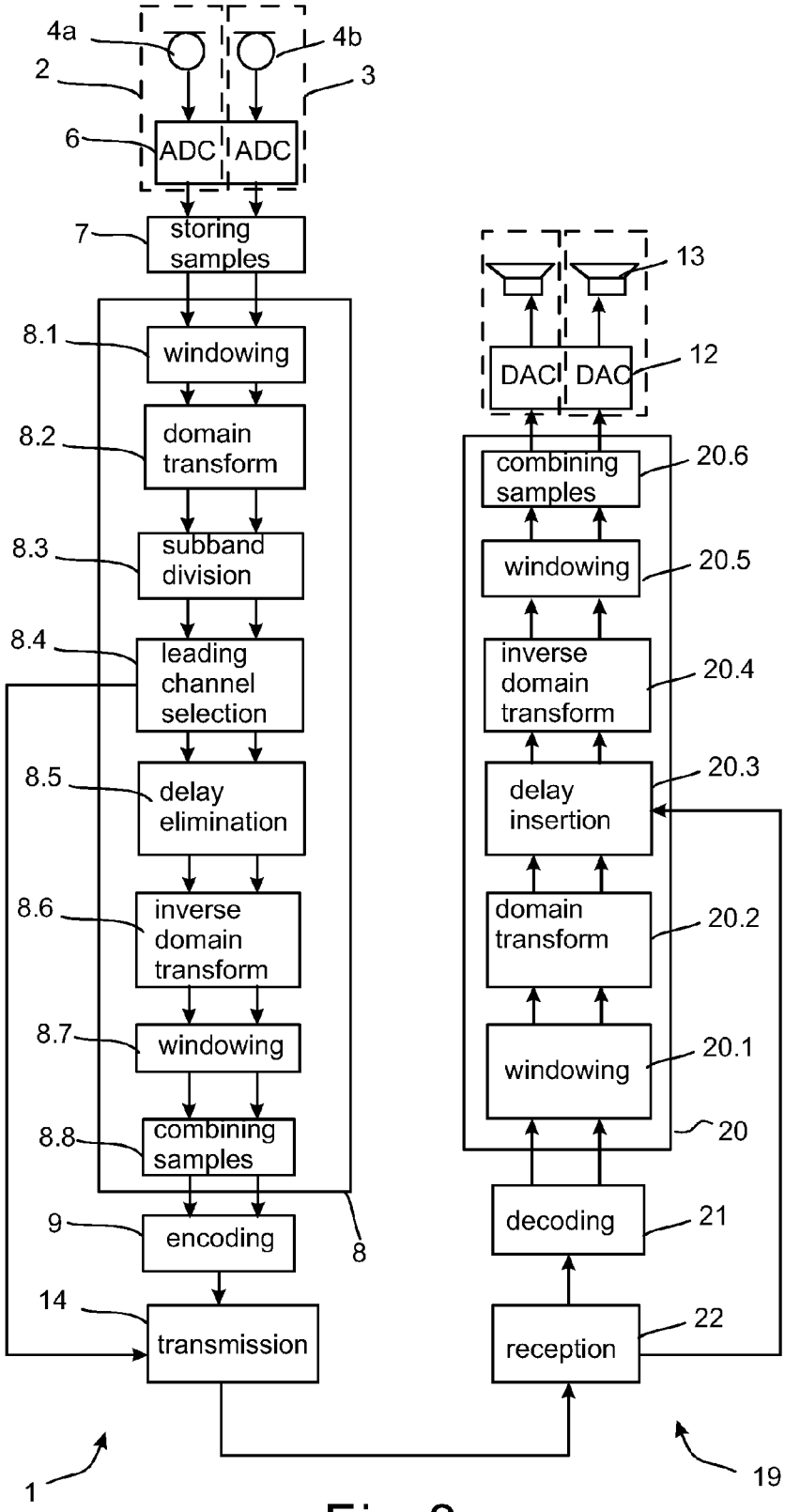
FIG. 3 depicts an example arrangement for encoding and decoding audio signals according to an example embodiment of the present invention.

In the following an example embodiment of the operation of the device 1 will be described in more detail with reference to FIG. 3. In this example embodiment there are two audio channels 2, 3 from which audio signals will be encoded by a first encoder 8. Without losing generality, the first audio channel 2 can be called as the left channel and the second audio channel 3 can be called as the right channel. The audio signals of the left and right channel can be formed e.g. by the microphones 4*a*, 4*b*. It is also possible that the audio signals for the left and right channel are artificially generated from a multiple of audio sources such as by mixing signals from different musical instruments into two audio channels or by processing a source signal for example using suitable HRTF/HRIR in order to create a binaural signal.

The analog-to-digital converter 6 converts the analog audio signals of the left and right channel into digital samples. These samples $S_L(t)$, $S_R(t)$ can be stored into the memory 7 for further processing. In the present invention the samples are organized into input frames I1, I2, I3, I4 which can further be organized into analyses frames F1, F2, F3, F4 (FIG. 4) so that one input frame represents a certain part of the audio signal in time domain. Successive input frames may have equal length i.e. each input frame contains the same number of samples or the length of the input frames may vary, wherein the number of sample in different input frames may be different. The same applies to the analysis frames i.e. successive analysis frames may have equal length i.e. each analysis frame contains the same number of samples or the length of the analysis frames may vary, wherein the number of sample in different analysis frames may be different. In FIG. 3 there is depicted an example of input and analysis frames which are formed from samples of the audio signals. For clarity, only four input frames and analysis frames per each channel are depicted in FIG. 3 but in practical situations the number of input frames and analysis frames can be different than that.

A first encoder 8 of the device 1 performs the analysis of the audio signals to determine the delay between the channels in a transform domain. The first encoding block 8 uses samples of the analysis frames of both channels in the analyses. The first encoding block 8 comprises a first windowing element 8.1. The first windowing element 8.1 prepares the samples for a time-to-frequency domain transform. The first windowing element 8.1 uses a window which can be constructed e.g. as follows:

$$\mathrm{win}(t) = \begin{cases} 0, & t = 0, \ldots, D_{max} - 1 \\ \mathrm{win}_c(t - D_{max}), & t = D_{max}, \ldots, D_{max} + L - 1 \\ 0, & t = D_{max} + L, \ldots, L + 2D_{max} - 1 \end{cases}, \quad (1a)$$

where $D_{max}$ is the maximum delay shift (in samples) allowed, $\mathrm{win}_c(t)$ is the center window and L is the length (in samples) of the center window. Thus in win(t) there are $D_{max}$ zeroes at both ends and the center window $\mathrm{win}_c(t)$ in the middle. This means that the samples modified by the center window $\mathrm{win}_c(t)$ and the zero values at both ends of the window win(t) are entered to a time-to-frequency domain transformer 8.2. The time-to-frequency domain transformer 8.2 produces a set of transform coefficients L(k), R(k) for further encoding. The time-to-frequency domain transformer 8.2 uses, for example, discrete fourier transform (DFT) or shifted discrete fourier transform (SDFT) in the transform. Also other transform methods can be used which transform information of time domain samples into frequency domain.

Figure 4:
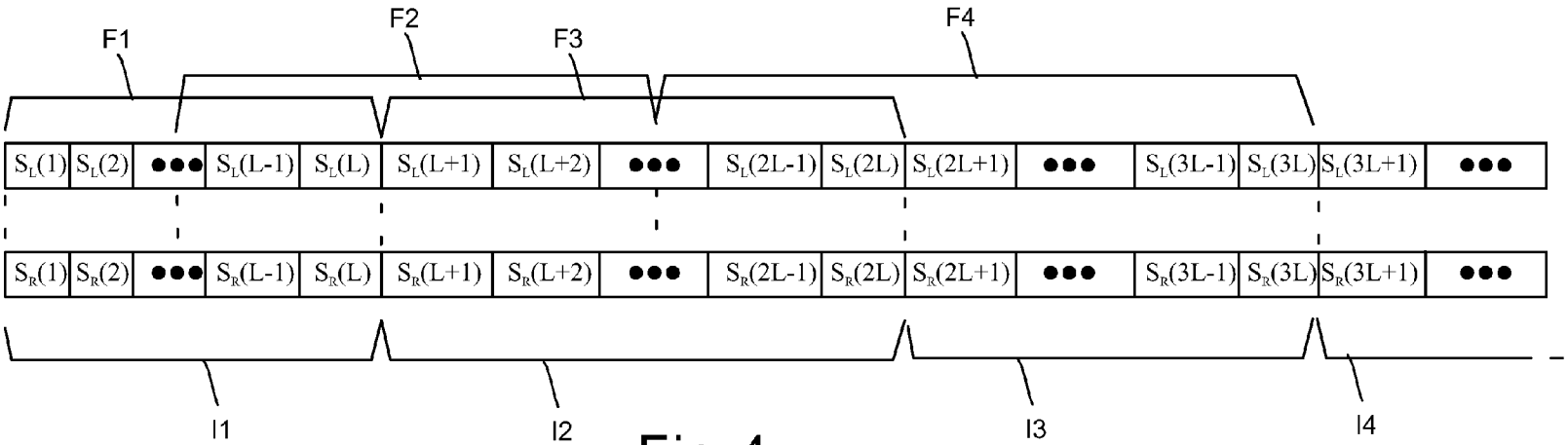
FIG. 4 depicts an example of samples arranged in input frames and analysis frames.

In this example embodiment the overlap of the analysis frames is $L/2+2D_{max}$ samples, i.e. it is over 50%. The next analysis frame starts L/2 samples after the starting instant of the previous analysis frame. In other words, the next analysis frame starts in the middle of the previous input frame. In FIG. 4 this is depicted so that two consecutive analysis frames, e.g. the first analysis frame F1 and the second analysis frame F2, have common samples i.e. they both utilize some of the samples of the same input frame I1.

Zeroes are used at the both ends of the window so that the frequency domain time shift do not cause perceptual artefacts due to samples circularly shifting from the beginning of the frame to the end, or vice versa.

It should be noted here that also other values than zeros can be used to construct the window win(t). As an example, values that are close to zero or other values that result in attenuating the respective portion of windowed signal to have amplitude that is essentially zero or close to zero can be used instead of zeros. It may also be sufficient to add zeros or other suitable values only to one side of the center window $\mathrm{win}_c(t)$. For example, the window can be constructed as follows:

$$\mathrm{win}(t) = \begin{cases} 0 & t = 0, \ldots, D_{max} - 1 \\ \mathrm{win}_c(t - D_{max}) & t = D_{max}, \ldots, D_{max} + L - 1 \end{cases}, \quad (1b)$$

or as follows:

$$\mathrm{win}(t) = \begin{cases} \mathrm{win}_c(t) & t = 0, \ldots, L - 1 \\ 0 & t = L, \ldots, D_{max} + L - 1 \end{cases}, \quad (1c)$$

In the analysis window according to the equation (1b), the zeros are added only in the beginning of the analysis window. Equally, the zeroes can be added only at the end of the window as defined by the equation (1c). Furthermore, it is possible to add any suitable number of zeros to the both ends of the window as long as the total number of zeroes is equal to or larger than $D_{max}$. With all analysis windows fulfilling this condition, the shifting can be performed to any direction, because with DFT transform samples which are shifted over the frame boundary appear at the other end of the window. Thus, a generalized from of the analysis window may be defined as follows.

$$\mathrm{win}(t) = \begin{cases} 0, & t = 0, \ldots, D_1 - 1 \\ \mathrm{win}_c(t - D_1), & t = D_1, \ldots, D_1 + L - 1 \\ 0, & t = D_1 + L, \ldots, L + D_1 + D_2 - 1 \end{cases}, \quad (1d)$$

where $D_1$ and $D_2$ are non-negative integer values and fulfil the condition $D_1+D_2 \geq D_{max}$.

In windows defined by the equation (1b), (1c) or (1d) the next analysis frame always starts L/2 samples after the starting instant of the previous analysis frame. It is also possible that the window size is not constant but it varies from time to time. In this description the length of current window is denoted as W.

Next, the transform coefficients are input to an analysis block 8.5 in which the delay between channels is determined for enabling the alignment of the transform coefficients of one audio channel with respect to another audio channel. The operation of the analysis block 8.5 will be described in more detail later in this application.

Figure 1A:
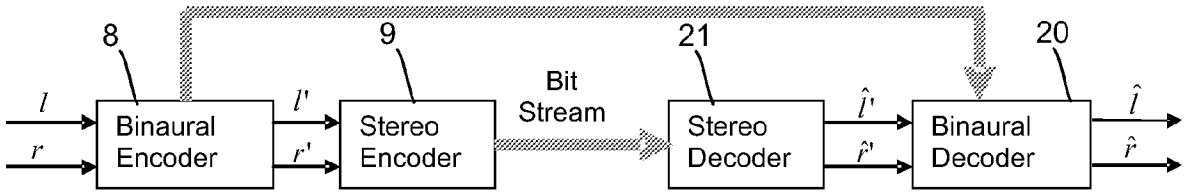
FIG. 1*a* depicts an example of a system for encoding and decoding audio signals by using a stereo core codec.
Figure 1B:
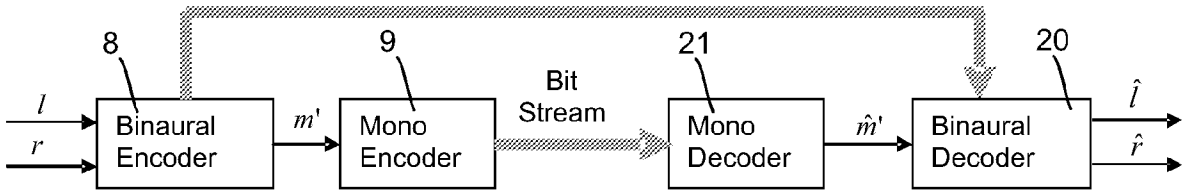
FIG. 1*b* depicts an example of a system for encoding and decoding audio signals by using a mono core codec.

The transform coefficients of the reference channel and the aligned channel can be encoded by a second encoder 9, which can be, for example, a stereo encoder as depicted in FIG. 1*a* or a mono encoder as depicted in FIG. 1*b*. The second encoder 9 encodes the channels e.g. by using the mid-side coding or parametric coding.

The signal formed by the second encoder 9 can be transmitted by the transmitter 14 to another electronic device 19, for example a wireless communication device. The transmission may be performed e.g. via a base station of a wireless communication network.

It should be noted that it is also possible that the encoded signal, which can be a bitstream, a series of data packets, or any another form of signal carrying the encoded information, is not immediately transmitted to another electronic device but it is stored to the memory 7 or to another storage medium. The encoded information can later be retrieved from the memory 7 or the storage medium for transmission to another device or for distribution to another device by some other means, or for decoding or other further processing by the same device 1.

Now, the operation of the elements of the first encoder 8 will be described in more detail. For illustrative purposes the left and right input channels are denoted as l and r, respectively. Both of the channels are windowed in the first windowing element 8.1 with overlapping windows as defined for example by the equation (1a), (1b), (1c) or (1d). In the equations (1a), (1b), (1c) and (1d) the center window, which in this example embodiment is a sinusoidal window $$\mathrm{win}_C(t) = \sin\left(\frac{\pi}{L}\left(t+\frac{1}{2}\right)\right),\ t = 0, \ldots, L-1, \tag{2}$$

fulfils the following condition: $\mathrm{win}_c(t)^2+\mathrm{win}_c(t+L/2)^2=1$.

Let L(k) and R(k), k=0, . . . , W−1 be the discrete fourier transform (DFT) domain coefficients of the current windowed left and right input frames, respectively. W is the length of the transform and is defined by the window length. Coefficients are symmetric around index $k_m$=W/2, such that for example L(km+k)=conj(L($k_m$−k), where conj denotes complex conjugate of the transform coefficient. For now on the discussion is concentrated only on the first $k_m$+1 transform coefficients.

After the windowed samples of both channels have been transformed from time domain to transform domain by the time-to-transform domain transformer 8.2 the discrete fourier transform domain channels may be divided into subbands by the subband divider 8.3. The subbands can be uniform i.e. each subband is equal in the bandwith, or non-uniform for example in such a way that at low frequencies the subbands are narrower and at higher frequencies wider. The subbands do not have to cover the whole frequency range but only a subset of the frequency range may be covered. For example, in some embodiments of the invention it may be considered sufficient that the lowest 2 kHz of the full frequency range is covered.

Let us denote the boundary indexes of B subbands as $k_b$, b=1, . . . , B+1. Now for example the bth subband of the right channel can be denoted as $R_b(k)=R(k_b+k)$, where k=0, . . . , $k_{b+1}-k_b-1$.

The leading channel selector 8.4 may select for each band one of the input channel audio signals as the "leading" channel. In an example embodiment of the invention, the leading channel selector 8.4 tries to determine in which channel the signal is leading the channel(s) i.e. in which channel a certain feature of the signal occurs first. This may be performed for example by calculating a correlation between two channels and using the correlation result to determine the leading channel. The leading channel selector 8.4 may also select the channel with the highest energy as the leading channel. In other embodiments, the leading channel selector may select the channel according to a psychoacoustic modelling criteria. In other embodiments of the invention, the leading channel selector 8.4 may select the leading channel by selecting the channel which has on average the smallest delay. However, in an embodiment where there are only two input audio channels they both have same delays in relation to each other with opposite signs. In some embodiments the leading channel may be a fixed channel, for example the first channel of the group of audio input channels may be selected to be the leading channel. Information on the leading channel may be delivered to the decoder 20 e.g. by encoding the information and providing it for the decoder along with the audio encoded data.

The selection of the leading channel may be made from analysis frame to analysis frame according to a predefined criteria.

One or more of the other channel(s) i.e. the non-leading channel(s) can be called as a trailing channel.

Corresponding subbands of the right and left channels are analyzed by the analysis block 8.5 to find the time difference (delay) between the channels. The delay is searched, for example, by determining a set of shifted signals for a subband of a first channel, each shifted signal corresponding to a delay value in a set of different delays, and for each shifted signal calculating a dot product between the shifted signals and respective signal of a second channel in order to determine a set of dot products associated with respective delay values in a set of different delays. A subband $R_b(k)$ can be shifted d samples in time domain using $$R_b^d(k) = R_b(k)\exp\left(\frac{-i2\pi d(k+k_b)}{W}\right), \tag{3}$$

in which positive values of the delay d shift time domain (subband) signal d samples to the left (earlier in time), and negative values of the delay d shift time domain (subband) signal |d| samples to the right (later in time), respectively. The shifting does not change the absolute values of the frequency domain parameters, only the phases are modified. Now the task is to find the delay d which maximizes the dot product between the complex-conjugates of the set of shifted frequency-domain subband signals of the right channel and respective (non-shifted) signals of the left channel $$\max_d \mathrm{real}\left(\sum_{k=0}^{k_{b+1}-k_b} \overline{R}_b^d(k)L_b(k)\right),\ d \in [-D_{max}, D_{max}] \tag{4}$$

where $\overline{R}_b^d(k)$ is the complex conjugate of $R_b^d(k)$ and real( ) indicates the real part of the complex-valued result. Only the real part of the dot product is used as it measures the similarity without any phase shifts. As an alternative, equation (4) may be modified in such a way that the real part of the dot products between the set of shifted frequency-domain subband signals of the right channel and complex-conjugate of the respective signals of the left channel are determined. With these computations the optimal shift $d_b$ for the current subband b is found. Information on the delay $d_b$ for the subband is also provided to a decoder 20. To keep the bit rate low the used set of allowed values for the delay $d_b$ may be limited.

For example at the highest frequencies it may not always be perceptually reasonable to modify the signal if they are not considered similar enough. The strength of similarity may be measured for example using the following equation:

$$W_b = \frac{\mathrm{real}\left(\sum_{k=0}^{k_{b+1}-k_b} \overline{R}_b^{d_b}(k)L_b(k)\right)}{\sum_{k=0}^{k_{b+1}-k_b} \left(\left|R_b^{d_b}(k)\right|\left|L_b(k)\right|\right)}. \tag{5}$$

If $W_b$ is smaller than a predefined threshold for the subband b, the delay $d_b$ is set to zero. In general, the thresholds may be subband dependent and/or may vary from frame to frame. As an example, lower thresholds may be used for subbands of higher frequencies.

According to an example embodiment of the present invention the channel in which a feature of the input signal appear first is not modified in the current subband. This implies that when time aligning the signals, no signal should ever be shifted later in time (delayed). This is perceptually motivated by the fact that the channel (subband) in which things happen first is perceptually more important and contains typically also more energy than the other channel(s). Since in the above example the optimal shift is searched for the right channel as shown in equations (3) and (4), the following logic can be used:

If the delay $d_b$ for the current subband b is greater than 0, then

Shift the transform coefficients of the right channel $R_b(k)$ $d_b$ samples using the equation (3), $k=0, \ldots, k_{b+1}-k_b-1$.

else

Shift the transform coefficients of the left channel $L_b(k)$ $-db$ samples using the equation (3), $k=0, \ldots, k_{b+1}-k_b-1$.

However, in some implementations it may be possible to apply shifting to delay the leading channel instead of, or in addition to, the shifting of the trailing channel.

The delay analysis and the shifting is performed independently for every subband. After a certain amount of the subbands or all subbands have been analysed and modified, the aligned DFT domain signals L'(k) and R'(k) have been obtained, which are then transformed to the time domain by the frequency-to-time domain transformer 8.6. In the time domain, the signals are again windowed by the second windowing element 8.7 which uses the window win(t) to remove perceptual artefacts outside the central part of the window. Finally the overlapping parts of the successive frames are combined, e.g. added together, to obtain aligned time domain signals l' and r'.

Next, the decoding of the encoded audio signals will be described in more detail with reference to the FIGS. 1*a*, 1*b* and 3. The decoding may be performed by the same device 1 which has the encoder 8, or by another device 19 which may or may not have the encoder 8 of the present invention.

The device 19 receives 22 the encoded audio signal. In the device 19 the first decoder 21, as illustrated in FIGS. 1*a* and 1*b*, encoded left and right channels $\hat{l}'$ and $\hat{r}'$ are obtained and input to the second decoder 20. In the second decoder 20 the third windowing element 20.1 performs windowing similar to the windowing used in the first encoder 8. The windowing results are transformed from time to frequency domain by the second time-to-frequency domain transformer 20.2. After the DFT transform the frequency domain signals $\hat{L}'(k)$ and $\hat{R}'(k)$ have been obtained. Now, the decoded delay values $d_b$ are obtained from the encoded data. The inverse signal modification of the encoder is now performed i.e. the delay between the signals will be restored by the delay insertion block 20.3. The delay insertion block 20.3 uses, for example, the following logic:

If the delay $d_b$ for the current subband b is greater than 0, then

Shift the transform coefficients of the right channel $R'_b(k)$ $-d_b$ samples using equation (3), $k=0, \ldots, k_{b+1}-k_b-1$.

else

Shift the transform coefficients of the left channel $L'_b(k)$ $d_b$ samples using equation (3), $k=0, \ldots, k_{b+1}-k_b-1$.

As a result, the transform coefficients of the left and right channel $\hat{L}(k)$ and $\hat{R}(k)$ are obtained, which are transformed to the time domain with inverse discrete fourier transform (IDFT) block 20.4, windowed by the fourth windowing element 20.5, and combined with overlap-add with the other frames by the second combiner 20.6. The digital samples can now be converted to analogue signal by the digital-to-analogue converter 12 and transformed into audible signals by the loudspeakers 13, for example.

The above description revealed some general concepts of the present invention. In the following some details of the core encoder i.e. the second encoder 9 and the core decoder i.e. the first decoder 22 will be described.

It is possible to perform core stereo coding for time aligned signals l' and r' totally independently of the binaural coding performed by the first encoder 8. This makes the implementation very flexible for all kinds of core coding methods. For example common mid-side or parametric stereo coders can be used.

Figure 5:
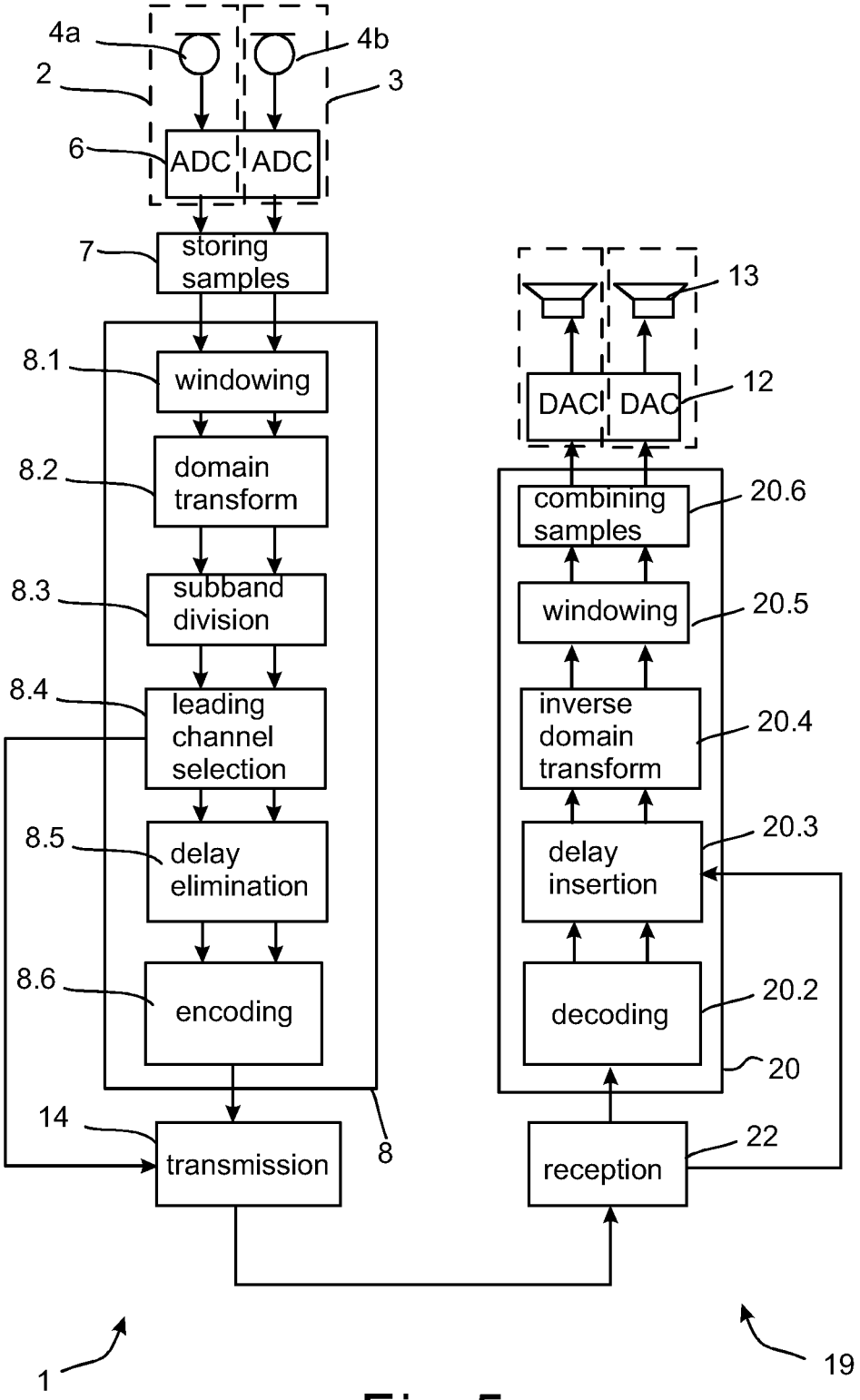
FIG. 5 depicts an example arrangement for encoding and decoding audio signals according to another example embodiment of the present invention.

Another possibility is to integrate the stereo coding part to the binaural codec wherein the second encoder 9 and the first decoder 21 are not needed. Both mid-side and parametric coding are in principle possible also in this case. In integrated coding one possibility is to do all the encoding in the frequency domain. An example embodiment of this is depicted in FIG. 5 in which similar reference numerals are used for the corresponding elements as in the embodiment of FIG. 3.

In binaural parametric coding the levels of the original signals are analyzed in the first encoder 8 and the information is submitted to the second decoder 20, either in the form of energy level or as scaling factors. Example embodiments for both of these methods are introduced here.

The DFT domain representation is divided into C energy subbands which cover the whole frequency band of the signal to be encoded. The boundary indexes of the subbands can be denoted as $k_c$, $c=1, \ldots, C+1$. It should be noticed that these subbands do not have to be the same subbands as used for the delay analysis. Now for example the c-th subband of the right channel can be denoted as $R_c(k)=R(k_c+k)$, where $k=0, \ldots, k_{c+1}-k_c-1$.

For both channels and for all gain subbands, the energies are calculated as $$E_X(c) = \log_{10}\left(\frac{\sum_{k=0}^{k_{c+1}-k_c-1} |X_c(k)|^2}{k_{c+1}-k_c-1}\right), \tag{6}$$

where X denotes either R or L. If it is selected that the energy values are submitted to the decoder, the energies are quantized to $\hat{E}_X(c)$. Notice that the energies may be estimated for example from R(k) or R'(k), since the magnitudes do not change in delay modification procedure. The total number of energy parameters is 2C as the energies are calculated separately for both channels.

The time aligned left and right channel signals L'(k) and R'(k) are combined to form a mono signal, for example by determining a sum of the left and right channels:

$$M'(k)=(L'(k)+R'(k))/2 \tag{7}$$

In some embodiments of the invention, the mono signal can also be calculated in the time domain. Now it is possible, as an alternative method, to compute gain values for energy subbands $$G_X(c) = \log_{10}\left(\sqrt{\frac{\sum_{k=0}^{k_{c+1}-k_c-1} |X_c(k)|^2}{\sum_{k=0}^{k_{c+1}-k_c-1} |M'_c(k)|^2}}\right), \tag{8}$$

where M'(k) has been divided into energy subbands similarly as X(k). $G_X(c)$ is quantized into $\hat{G}_X(c)$ and submitted to the second decoder 20. Logarithmic domain representation is used based on properties of human perception.

The mono signal m'(t) (time domain equivalent of M'(k)) is encoded with a mono encoder as presented in FIG. 1*b*. In the decoder a synthesized mono signal $\hat{m}'(t)$ will be obtained which is windowed and transformed to the frequency domain to produce the frequency domain representation $\hat{M}'(k)$ of the synthesized mono signal. Next, the frequency domain left channel signal $\hat{L}'(k)$ and the right channel signal $\hat{R}'(k)$ are obtained from $\hat{M}'(k)$ with a scaling operation, which is performed separately for every energy subband and for both channels. In the case of quantized energy values the scaled signals are obtained as $$\hat{X}'_c(k) = \frac{10^{\hat{E}_X(c)}(k_{c+1} - k_c - 1)}{\sum_{k=0}^{k_{c+1}-k_c-1} |\hat{M}'_c(k)|^2} \hat{M}'(k), \quad k = 0, \ldots, k_c + 1 - k_c - 1, \tag{9}$$

If scaling factors $G_X$ were used, scaled signals are obtained simply as $$\hat{X}_c'(k) = 10^{\hat{G}_X} \hat{M}_c'(k), \tag{10}$$

Both in the equations (9) and (10) the notation X is either L for the left channel or R for the right channel. Equations (9) and (10) simply return the energy of the subband to the original level. After this has been performed for all energy subbands in both channels, processing can be continued by the delay insertion block 20.3 for returning delays to their original values.

Depending on the core coding method, the spatial ambience of decoded binaural signal as perceived by the user may shrink compared to the original signal. It means that even though the directions of the sounds are correct, the ambience around the listener may not sound genuine. This may be because the two channels are so similar that sounds do not perceptually externalize from the inside of the listeners head. This is especially typical when parametric representation of the spatial signal is used. This holds both in the case when parametric stereo coding has been integrated with the binaural codec (FIG. 1*b*) and when parametric stereo coding is used outside the actual binaural coding part (FIG. 1*a*).

Externalization can be improved with the means of decorrelation processing. The need for the decorrelation processing can be estimated for example using coherence analysis for the input signals:

$$H = \frac{\sum_{k=N_1}^{N_2} |L(k)||R(k)|}{\sqrt{\left(\sum_{k=N_1}^{N_2} |L(k)|^2\right)\left(\sum_{k=N_1}^{N_2} |R(k)|^2\right)}}, \tag{11}$$

where N1 and N2 define the frequency region from where the similarity is measured. The value of H varies in range [0, 1], and the smaller the value is the less there is similarity between channels and the stronger is the need for decorrelation. The value of H may be quantized to $\hat{H}$ and submitted to the decoder.

In one embodiment of the invention, an all-pass type of decorrelation filter may be employed to the synthesized binaural signals. The used filter is of the form $$D(z) = \frac{\alpha + z^{-P}}{1 + \alpha z^{-P}}, \tag{12}$$

where P is set to a fixed value, for example 50 samples for 32 kHz signal. The parameter $\alpha$ is used such that it gets opposite values for the two channels, for example values 0.4 and −0.4 can be used for left and right channels, respectively. This maximizes the perceptual decorrelation effect.

The synthesized (output) signal is now obtained as $$\tilde{L}(z)\beta_1 z^{-PD\hat{L}}(z) + \beta_2 D(z)\hat{L}(z)$$

$$\tilde{R}(z)\beta_1 z^{-PD\hat{R}}(z) + \beta_2 D(z)\hat{R}(z) \tag{13}$$

where $\beta_1$ and $\beta_2$ are scaling factors obtained as a function of $\hat{H}$, for example $\beta_1 = \hat{H}$ and $\beta_2 = 1 - \beta_1$. Alternatively it is for example possible to select $\beta_1$ and $\beta_2$ such that in case of two independent signals the energy level is maintained, i.e. $\beta_1 = \hat{H}$, $\beta_1^2 + \oplus_2^2 = 1$. In equation (11) PD is the average group delay of the decorrelation filter of the equation (12).

In true binaural recordings (recorded with artificial head or using a head set with microphones in the ears) a typical situation is that $\beta_2$ is set to 1 and $\beta_1$ to zero. If the binaural signal has been generated artificially, for example by using head related transfer functions (HRTF) or head related impulse responses (HRIR), it is typical that channels are strongly correlated and $\beta_1$ is set to one, and $\beta_2$ to zero. If the value of $\hat{H}$ changes from one frame to another, for example linear interpolation can be used for $\beta_1$ and $\beta_2$ values between time domain instants when the parameters are updated such that there are no sudden changes in the values.

The usage of the scaling factors for decorrelation is also dependent on the properties of the core codec. For example if a mono core codec is used, strong decorrelation may be needed. In the case of a parametric stereo core codec, the need for decorrelation may be at the average level. When a mid-side stereo is used as the core codec, there may not be a need for decorrelation or only a mild decorrelation may be used.

In the above one possible implementation for a binaural codec was presented. However, it is obvious that there can be numerous different implementations with slightly different operations. For example, the Shifted Discrete Fourier Transform (SDFT) can be used instead of the DFT. This enables for example direct transform from SDFT domain to MDCT domain in the encoder, which enables efficient implementation with low delay.

In the above described implementation there are $D_{max}$ zeroes at at least one end of the window. However, it is possible to have an embodiment of the invention without using these zeroes; in that case the samples are cyclically shifted from one end of the window to the other when the time shift is applied. This may result in compromised audio quality, but on the other hand computational complexity is slightly lower due to inter alia shorter transforms and less overlap.

The central part of the proposed window does not have to be sinusoidal window as long as the condition mentioned after the equation (2) is fulfilled. Different techniques can be used for computing the energies (equation (6)) without essentially changing the main idea of the invention. It is also possible to calculate and quantize gain values instead of energy levels.

There are also several possibilities for calculating the need for decorrelation (equation (9) as well as for implementing the actual decorrelation filter.

The delay estimation may also be recursive wherein the analysis block 8.5 uses first a coarser resolution in the search and after approaching the correct delay the analysis block 8.5 can use a finer resolution in the search to make the delay estimate more accurate.

It is also possible that the first encoder 8 does not align the signals of the different channels but only determines the delay and informs it to the second decoder 20 wherein the combined signal is provided for decoding without delaying. In this embodiment the second decoder 20 delays the signal of the other channel.

As used in this application, the term 'circuitry' refers to all of the following:

(a) to hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone, a server, a computer, a music player, an audio recording device, etc, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

The invention is not solely limited to the above described embodiments but it can be varied within the scope of the appended claims.

The invention claimed is:

1. A method comprising:

using samples of at least a part of an audio signal of a first channel and a part of an audio signal of a second channel to estimate a time delay between said part of the audio signal of said first channel and said part of the audio signal of said second channel;

windowing the samples of said first channel and said second channel by a window function to form an analysis frame of said first channel and an analysis frame of said second channel;

performing a time-to-frequency domain transform on the analysis frames to form a frequency domain representation of said part of the audio signal of said first channel and said part of the audio signal of said second channel;

determining an inter-channel time delay between said part of the audio signal of the first channel and said part of the audio signal of said second channel on the basis of the frequency domain representations;

searching similarities within signals of the first channel and the second channel at each subband; and time aligning the first channel and the second channel to compensate for the determined inter-channel time delay only on such subbands in which said searching similarities indicates that the signal of the first channel and the signal of the second channel can be considered similar enough, wherein said time aligning comprises shifting the second channel in relation to the determined inter-channel time delay.

2. The method according to claim 1, wherein said window function comprises a first window and a set of predetermined values at least at one end of the first window wherein said predetermined values are zeros.

3. The method according to claim 2, wherein said window function is $$\mathrm{win}(t) = \begin{cases} 0, & t = 0, \ldots, D_{max} - 1 \\ \mathrm{win}_c(t - D_{max}), & t = D_{max}, \ldots, D_{max} + L - 1 \\ 0, & t = D_{max} + L, \ldots, L + 2D_{max} - \end{cases}$$

where $D_{max}$ is a predefined maximum delay shift allowed, $\mathrm{win}_c(t)$ is the first window and L is the length of the first window.

4. The method according to claim 1, wherein said determining comprises:

shifting the frequency domain representation of the second channel to represent a delayed audio signal of the second channel;

defining a dot product between the frequency domain representation of the first channel and complex conjugate values of the shifted frequency domain representation of the second channel; and determining the inter-channel time delay as a value for the shift which maximizes a real value of the dot product.

5. The method according to claim 4, wherein said determining comprises:

dividing the frequency domain representations into a number of subbands; and performing the delay estimation at at least one subband of said number of subbands.

6. The method according to claim 1, wherein said searching similarities comprises:

defining a dot product between the frequency domain representation of the first channel and complex conjugate values of the shifted frequency domain representation of the second channel;

finding a value for the shift which maximizes a real value of the dot product; and comparing the maximum of the real value of the dot product with a threshold to determine whether the signal of the first channel and the signal of the second channel can be considered similar enough at the subband.

7. The method according to claim 1, wherein said searching similarities comprises:

defining a correlation between the frequency domain representation of the first channel and complex conjugate values of the shifted frequency domain representation of the second channel;

finding a value for the shift which maximizes the correlation; and comparing the correlation with a threshold to determine whether the signal of the first channel and the signal of the second channel can be considered similar enough at the subband.

8. The method according to claim 4, wherein a set of shift values is defined, wherein the method comprises selecting the shift from said set of shift values to determine the inter-channel time delay.

9. The method according to claim 1, wherein the method comprises:

determining a need for decorrelation between said audio signal of the first channel and said audio signal of the second channel; and providing an indication of the need for decorrelation.

10. An apparatus comprising:

one or more processors; and one or more memories including computer program code configured, with the one or more processors, to cause the apparatus to perform the following:

using samples of at least a part of an audio signal of a first channel and a part of an audio signal of a second channel to estimate a time delay between said part of the audio signal of said first channel and said part of the audio signal of said second channel;

windowing the samples of said first channel and said second channel by a window function to form an analysis frame of said first channel and an analysis frame of said second channel;

performing a time-to-frequency domain transform on the analysis frames to form a frequency domain representation of said part of the audio signal of said first channel and said part of the audio signal of said second channel;

determining an inter-channel time delay between said part of the audio signal of the first channel and said part of the audio signal of said second channel on the basis of the frequency domain representations;

searching similarities within signals of the first channel and the second channel at each subband; and time aligning the first channel and the second channel to compensate for the determined inter-channel time delay only on such subbands in which said searching similarities indicates that the signal of the first channel and the signal of the second channel can be considered similar enough, wherein said time aligning comprises shifting the second channel in relation to the determined inter-channel time delay.

11. The apparatus according to claim 10, wherein said window function comprises a first window and a set of predetermined values at least at one end of the first window wherein said predetermined values are zeros.

12. The apparatus according to claim 11, wherein said window function is $$\mathrm{win}(t) = \begin{cases} 0, & t = 0, \ldots, D_{max} - 1 \\ \mathrm{win}_c(t - D_{max}), & t = D_{max}, \ldots, D_{max} + L - 1 \\ 0, & t = D_{max} + L, \ldots, L + 2D_{max} - \end{cases}$$

where $D_{ma}$ is a predefined maximum delay shift allowed, $\mathrm{win}_c(t)$ is the first window and L is the length of the first window.

13. The apparatus according to claim 10, wherein said determining comprises:

shifting the frequency domain representation of the second channel to represent a delayed audio signal of the second channel; and defining a dot product between the frequency domain representation of the first channel and complex conjugate values of the shifted frequency domain representation of the second channel; and determining the inter-channel time delay as a value for the shift which maximizes a real value of the dot product.

14. The apparatus according to claim 13, wherein said determining comprises:

dividing the frequency domain representations into a number of subbands; and performing the delay estimation at at least one subband of said number of subbands.

15. The apparatus according to claim 10, wherein said searching similarities comprises:

defining a dot product between the frequency domain representation of the first channel and complex conjugate values of the shifted frequency domain representation of the second channel;

finding a value for the shift which maximizes a real value of the dot product; and comparing the maximum of the real value of the dot product with a threshold to determine whether the signal of the first channel and the signal of the second channel can be considered similar enough at the subband.

16. The apparatus according to claim 10, wherein said searching similarities comprises:

defining a correlation between the frequency domain representation of the first channel and complex conjugate values of the shifted frequency domain representation of the second channel;

finding a value for the shift which maximizes the correlation; and comparing the correlation with a threshold to determine whether the signal of the first channel and the signal of the second channel can be considered similar enough at the subband.

17. The apparatus according to claim 10, wherein a set of shift values is defined, and wherein said one or more memories including computer program code are further configured, with the one or more processors, to cause the apparatus to perform selecting the shift from said set of shift values to determine the inter-channel time delay.

18. The apparatus according to claim 10, wherein said one or more memories including computer program code are further configured, with the one or more processors, to cause the apparatus to perform:

determining a need for decorrelation between said audio signal of the first channel and said audio signal of the second channel; and providing an indication of the need for decorrelation.

19. A computer program product comprising a non-transitory computer-readable storage medium bearing computer program code embodied therein for use with a computer, the computer program code comprising code for performing the following:

use samples of at least a part of an audio signal of a first channel and a part of an audio signal of a second channel to estimate a time delay between said part of the audio signal of said first channel and said part of the audio signal of said second channel;

window the samples of said first channel and said second channel by a window function to form an analysis frame of said first channel and an analysis frame of said second channel;

perform a time-to-frequency domain transform on the analysis frames to form a frequency domain representation of said part of the audio signal of said first channel and said part of the audio signal of said second channel;

determine an inter-channel time delay between said part of the audio signal of the first channel and said part of the audio signal of said second channel on the basis of the frequency domain representations;

search similarities within signals of the first channel and the second channel at each subband; and time align the first channel and the second channel to compensate for the determined inter-channel time delay only on such subbands in which said searching similarities indicates that the signal of the first channel and the signal of the second channel can be considered similar enough, wherein said time aligning comprises shifting the second channel in relation to the determined inter-channel time delay.

* * * * *